United States Patent [19]

Fischer

[11] Patent Number: 4,458,884

[45] Date of Patent: Jul. 10, 1984

[54] HEAD MIXER AND THERMAL CONDUCTOR FOR A CUTTING TORCH

[76] Inventor: Robert A. Fischer, 1903 Avenue C, Katy, Tex. 77449

[21] Appl. No.: 546,231

[22] Filed: Oct. 27, 1983

[51] Int. Cl.[3] ..... B23K 7/00

[52] U.S. Cl. ..... 266/48

[58] Field of Search ..... 266/48

[56] References Cited

U.S. PATENT DOCUMENTS

| | | | |
|---|---|---|---|
| 3,463,601 | 8/1969 | Childree | 266/48 |
| 4,022,441 | 5/1977 | Turney | 266/48 |
| 4,030,710 | 6/1977 | Turney | 266/48 |
| 4,248,384 | 2/1981 | Swicker | 239/419 |
| 4,413,809 | 11/1983 | Fischer | 266/48 |

*Primary Examiner*—W. Stallard

*Attorney, Agent, or Firm*—Fulbright & Jaworski

[57] ABSTRACT

In a two tube cutting torch having a torch head and a body with a first cutting oxygen tube supplying oxygen from the body to the head and a second preheat tube supplying oxygen and fuel from the body to the head in which the body has a fuel inlet and an oxygen inlet and control means connected to the body for controlling the flow of fuel and oxygen, the improvement of a head mixer and thermal conductor. A member is connected between the preheat tube and the head and the member includes a straight through bore interconnecting the preheat tube and the head and the bore at the tube end is in communication with oxygen in the preheat tube. The member also includes one or more passageways extending from the tube end and is in communication with fuel in the preheat tube. The member includes one or more holes adjacent the head end extending from the bore to the passageways for aspirating fuel from the passageways into the bore and mixing in the head as oxygen flows through the bore to the head. A plurality of thermal ribs are provided about the exterior of the body for dissipating heat from the member. Preferably the thermal ribs contact the cutting oxygen tube and abut the head for more quickly dissipating heat. Preferably the member extends into the head thereby positioning the holes in the interior of the head for mixing the fuel and oxygen in the head.

4 Claims, 3 Drawing Figures

Fig. 1
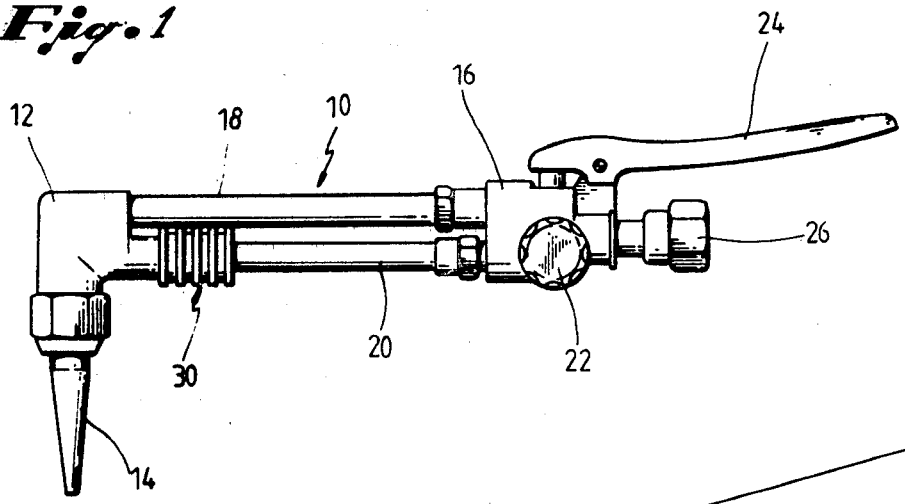
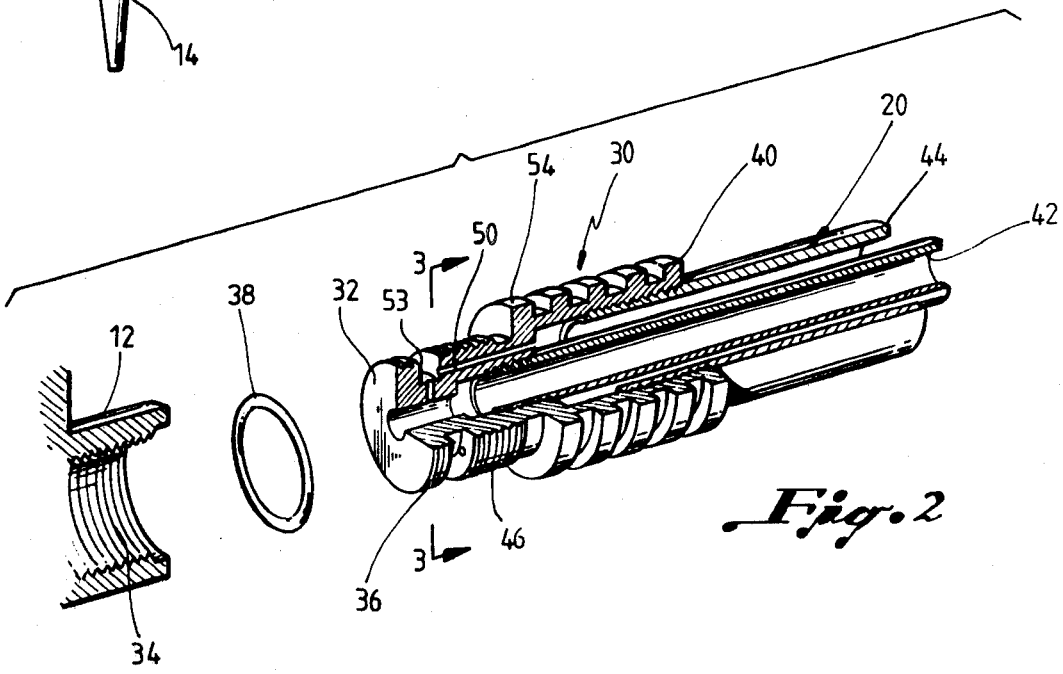
Fig. 2
Fig. 3
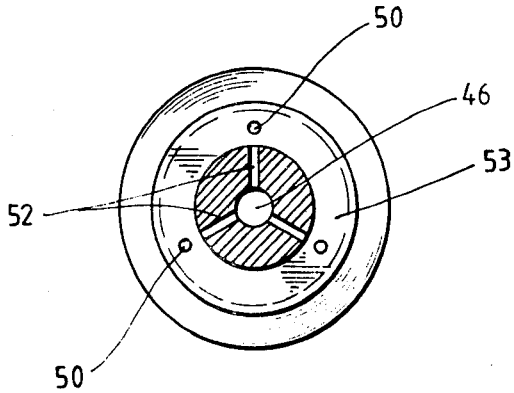

HEAD MIXER AND THERMAL CONDUCTOR FOR A CUTTING TORCH

BACKGROUND OF THE INVENTION

As discussed in my copending patent application, Ser. No. 423,363, filed Sept. 24, 1982, entitled Anti-Flashback Cutting Torch, and as discussed in U.S. Pat. No. 4,022,441, injector type cutting torches have had a major drawback, that being the tendency to have sustained burning on flashback which could in fact burn up the torch. My prior application and U.S. Pat. No. 4,022,441 utilize various structures in the preheat tube of the cutting torch to avoid flashback. And while it is known to utilize mixing the oxygen and fuel in the head of a three tube cutting torch, as described in U.S. Pat. No. 4,248,384, applicant knows of no two tube cutting torch or cutting attachment that have provisions to mix the oxygen and fuel in the head and reduce the possibility of flashback.

The present invention is directed to a combination head mixer and thermal conductor for use in a two tube cutting torch or cutting attachment which provides a simple but effective way for reducing flashback and eliminates sustained burning caused by the flashback.

SUMMARY

It is an object of the present invention to provide an improvement for use in a two tube cutting torch to provide mixing of the oxygen and fuel in the head for reducing flashback.

Still a further object of the present invention is the provision of a head mixer having a thermal conductor which dissipates heat for further reducing the chances of flashback.

Yet a still further object of the present invention is the improvement in a two tube cutting torch having a torch head and a body with a first cutting oxygen tube supplying oxygen form the body to the head and a second preheat tube supplying oxygen and fuel from the body to the head in which the body has a fuel inlet and an oxygen inlet and control means connected to the body for controlling the flow of fuel and oxygen. The improvement is directed to a head mixer and thermal conductor which includes a member connected between the preheat tube and the head. The member includes a straight through bore interconnecting the preheat tube and the head and the bore at the tube end of the member is in communication with oxygen in the preheat tube. The member also includes one or more passageways extending from the preheat tube end which are in communication with fuel in the preheat tube. One or more holes are provided in the member adjacent the head end in which the holes extend from the bore to the passageways for aspirating fuel from the passageways into the bore and mixing in the head as oxygen flows through the bore to the head. In addition, a plurality of thermal ribs are provided about the exterior of the body for dissipating heat from the member.

A still further object of the present invention is wherein the thermal ribs contact the cool cutting oxygen tube and preferably abut the head for more quickly dissipating heat.

A still further object is wherein the head end of the member extends into the head thereby positioning the holes in the interior of the head for mixing the oxygen and fuel in the head.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is an elevational view of a cutting attachment for a conventional cutting torch, FIG. 2 is an isometric exploded view of a head mixer and thermal conductor of the present invention, and FIG. 3 is an enlarged cross-sectional view taken along the line 3—3 of FIG. 2.

DESCRIPTION OF THE PREFERRED EMBODIMENT

While the present invention is useful in various types of cutting torches and cutting attachments in providing an oxygen and fuel mixing in the head of the torch, the present invention can be used in any suitable two tube cutting torch or cutting attachment, and the present invention will be described, for purposes of illustration only, as used in a Model CA1350 cutting attachment of Victor Equipment Company.

Referring now to FIGS. 1 and 2, the reference numeral 10 generally indicates a cutting attachment having a head 12, a tip 14 connected thereto, and a body 16. A cutting oxygen tube 18 is connected between the torch head 12 and the body 16 for supplying oxygen from the body 16 to the head 12. A preheat tube assembly 20 is also connected between the torch head 12 and the body 16. The preheat tube 20 separately supplies oxygen and fuel from the body 16 to the head 12.

The body 16 includes an oxygen flow control valve 22 and a cutting oxygen flow control valve 24. In addition, the body includes a fuel and oxygen inlet 26. The body 16 conventionally includes passageways whereby the control of the cutting oxygen flow control valve 24 opens and closes to supply oxygen through the cutting oxygen tube 18 to the torch head 12 and the torch tip 14. Both fuel and oxygen is supplied from the body 16 to the preheat tube assembly 20.

The above description of a cutting attachment is conventional. However, as indicated in the prior art, sustained burning on flashback has long been a problem in cutting torches and attachments. Various types of structures have been proposed such as diffusers, injection type mixers, frustro conical nose sections, and spiral inserts in the preheat tube, and mixing in the head in three tube torches.

The present invention is directed to a head mixer in which the fuel and oxygen from the preheat tube is mixed in the head 12 for reducing flashback and in which the heat in the mixer is quickly dissipated to additionally reduce the tendency of having a flashback in the preheat tube 20.

A member generally indicated by the reference numeral 30 is connected between the preheat tube 20 and the head 12. While any type of suitable connection may be used such as soldering, the head end 32 of the member 30 is preferably inserted into the interior of the head 12 such as by coacting threads 34 and 36 and sealed with O-ring 38. The preheat tube end 40 is connected to an inner tube 42 which conducts oxygen and an outer tube 44 which conducts a gaseous fuel such as acetylene. Both tubes 42 and 44 are part of the preheat tube assembly 20. The member 30 includes a straight through bore 46 interconnecting the preheat tube 20 and the head 12.

The bore 46 at the preheat tube end is connected to the oxygen line 42 for communicating oxygen from the preheat tube 20 to the head 12.

The member 30 also includes one or more passageways 50 extending from the tube end and being in communication and receiving fuel from line 44. The member 30 also includes one or more holes 52 adjacent the head end of the member 30 and extending from the bore 46 to communicate with the passageways 50 such as through a groove 53. Thus, oxygen flowing through the bore 46 will aspirate fuel from the passageways 50 into the bore 46 for mixing in the head 12 as the oxygen flows through the bore 46 to the head 12. Preferably, it is noted that the head end 32 of the member 30 extends into the head 12 thereby positioning the holes 50 in the interior of the head for mixing the oxygen and fuel in the head.

It is further desirable to cool the mixer 30 to additionally keep the temperature of the oxygen and fuel in the mixer 30 and preheat tube 20 as low as possible to prevent flashback and combustion. Thus, the member 30 is provided with a plurality of circularly extending thermal ribs 54 about the exterior of the member 30 for dissipating heat from the member 30. Preferably, the thermal ribs contact the end of the head 12 for dissipating the heat adjacent the mixing chamber in the head 12. In addition, it is preferable that the thermal ribs 54, contact the exterior of the cutting oxygen tube 18, as best seen in FIG. 1, for more quickly dissipating heat to the cooler tube 18. In addition, this preheats the cutting oxygen in the cutting tube 18 for saving energy.

In operation, oxygen is continuously flowed through the bore 46 and will aspirate the gaseous fuel in the passages 50 for mixing the oxygen and fuel in the head 12 for reducing the possibility of flashbacks. In addition, the thermal conductor ribs 54 keeps the temperature of the member 30 and the adjacent portion of the preheat tube 20 below the heat range that would create combustion.

The design of the mixer and thermal conductor member 30 is also advantageous due to its simple design and economical cost of manufacturing.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a two tube cutting torch having a torch head and a body with a first cutting oxygen tube supplying oxygen from the body to the head, and a second preheat tube supplying oxygen and fuel from the body to the head, said body having a fuel inlet and oxygen inlet and control means connected to the body for controlling the flow of fuel and oxygen, the improvement of a head mixer and thermal conductor comprising, a member connected between the preheat tube and the head, said member having a straight through bore interconnecting the preheat tube and the head, and the bore at the tube end being in communication with oxygen in the tube, said member having a passageway extending from the tube end and in communication with fuel in the preheat tube, said member having one or more holes adjacent the head end extending from the bore to the passageway for aspirating fuel from the passageway into the bore and mixing in the head as oxygen flows through the bore to the head, and a plurality of thermal ribs about the exterior of the body for dissipating heat from the member.

2. The apparatus of claim 1 wherein the thermal ribs contact the cutting oxygen tube for more quickly dissipating heat.

3. The apparatus of claim 1 wherein one end of the member extends into the head thereby positioning the holes in the interior of the head for mixing the oxygen and fuel in the head.

4. The apparatus of claim 2 wherein the ribs abut the head.

* * * * *